US011309142B1

(12) United States Patent
Chang et al.

(10) Patent No.: US 11,309,142 B1
(45) Date of Patent: Apr. 19, 2022

(54) KEYBOARD DEVICE

(71) Applicant: Primax Electronics Ltd., Taipei (TW)

(72) Inventors: Chia-Wei Chang, Taipei (TW); Chin-Sung Pan, Taipei (TW)

(73) Assignee: PRIMAX ELECTRONICS LTD., Taipei (TW)

( * ) Notice: Subject to any disclaimer, the term of this patent is extended or adjusted under 35 U.S.C. 154(b) by 0 days.

(21) Appl. No.: 17/240,150

(22) Filed: Apr. 26, 2021

(30) Foreign Application Priority Data

Mar. 16, 2021 (TW) ..... 110109236

(51) Int. Cl.
*H01H 3/12* (2006.01)
*H01H 13/70* (2006.01)

(52) U.S. Cl.
CPC ..... *H01H 3/125* (2013.01); *H01H 13/70* (2013.01)

(58) Field of Classification Search
CPC ..... H01H 3/125; H01H 13/705; H01H 13/14; H01H 13/70; H01H 13/704; H01H 13/7065; H01H 13/7006; H01H 13/7057; H01H 13/78; H01H 13/79; H01H 13/52; H01H 13/703; H01H 13/507
See application file for complete search history.

(56) References Cited

U.S. PATENT DOCUMENTS 8,957,332 B2 * 2/2015 Yamada ..... H01H 3/125 200/344
2014/0367240 A1 * 12/2014 Lin ..... H01H 3/125 200/344
2018/0025859 A1 * 1/2018 Chen ..... H01H 13/7065 200/5 A

* cited by examiner

*Primary Examiner* — Ahmed M Saeed
(74) *Attorney, Agent, or Firm* — Kirton McConkie; Evan R. Witt

(57) ABSTRACT

A keyboard device includes a base plate and a key structure. The base plate includes a first coupling part. The first coupling part includes a first locking hole. The key structure includes a keycap, a stabilizer bar and a first connecting element. The stabilizer bar is arranged between the keycap and the base plate. The stabilizer bar includes a transverse bar part and a first hook part. The transverse bar part is pivotally coupled to the keycap. The first hook part is penetrated through the first locking hole of the first coupling part. The first connecting element includes a first supporting structure. The first supporting structure is arranged between the first hook part of the stabilizer bar and the base plate. The first hook part is supported by the first supporting structure. Consequently, the first hook part is contacted with an inner wall of the first locking hole.

9 Claims, 11 Drawing Sheets

KEYBOARD DEVICE

FIELD OF THE INVENTION

The present invention relates to an input device, and more particularly to a keyboard device with plural key structures.

BACKGROUND OF THE INVENTION

With increasing development of science and technology, a variety of electronic devices are designed in views of convenience and user-friendliness. For helping the user well operate the electronic devices, the electronic devices are gradually developed in views of humanization. The input devices of the common electronic devices include for example mouse devices, keyboard devices, trackball devices, or the like. Via the keyboard device, characters or symbols can be inputted into the computer system directly. As a consequence, most users and most manufacturers of input devices pay much attention to the development of keyboard devices.

The structures and the functions of a conventional keyboard device will be illustrated as follows. Please refer to FIGS. 1, 2 and 3. FIG. 1 is a schematic top view illustrating the outer appearance of a conventional keyboard device. FIG. 2 is a schematic exploded view illustrating a portion of the keyboard device of FIG. 1 and taken along a viewpoint. FIG. 3 is a schematic exploded view illustrating a portion of the keyboard device of FIG. 1 and taken along another viewpoint. For succinctness, only one key structure 10' and related components are shown in FIGS. 2 and 3.

The conventional keyboard device 1 comprises plural key structures 10 and 10', a base plate 11 and a membrane circuit board 12. The membrane circuit board 12 comprises plural membrane switches 121 corresponding to the plural key structures 10 and 10'. Each of the plural key structures 10 and 10' comprises a keycap 101, at least one scissors-type connecting element 102 and an elastic element 103. The scissors-type connecting element 102 is connected between the keycap 101 and the base plate 11. Moreover, the scissors-type connecting element 102 comprises a first frame 1021 and a second frame 1022. The second frame 1022 is pivotally coupled to the first frame 1021. Consequently, the first frame 1021 and the second frame 1022 can be swung relative to each other. The elastic element 103 is arranged between the keycap 101 and the membrane circuit board 12. Moreover, the elastic element 103 comprises a contacting part 1031.

While the keycap 101 of any key structure 10 or 10' is depressed and moved downwardly relative to the base plate 11, the first frame 1021 and the second frame 1022 of the scissors-type connecting element 102 are switched from an open-scissors state to a stacked state. Moreover, as the keycap 101 is moved downwardly to compress the elastic element 103, the corresponding membrane switch 121 is pushed and triggered by the contacting part 1031 of the elastic element 103. Consequently, the keyboard device 1 generates a corresponding key signal. When the key structure 10 or 10' is no longer depressed, the keycap 101 is moved upwardly relative to the base plate 11 in response to an elastic force of the elastic element 103. Meanwhile, the first frame 1021 and the second frame 1022 are switched from the stacked state to the open-scissors state again, and the keycap 101 is returned to its original position.

As shown in the drawings, the length L of the key structure 10' is much larger than the width W of the key structure 10'. The key structure 10' further comprises two stabilizer bars 104. Each stabilizer bar 104 comprises a transverse bar part 1041 and two hook parts 1042. The two hook parts 1042 are located at two ends of the transverse bar part 1041, respectively.

The base plate 11 comprises a first coupling part 111 and a second coupling part 112. The first coupling part 111 and the second coupling part 112 are protruded upwardly and penetrated through the membrane circuit board 12. The first coupling part 111 comprises two first locking holes 1111. The second coupling part 112 comprises two second locking holes 1121 corresponding to the two first locking holes 1111.

The transverse bar part 1041 of the stabilizer bar 104 is pivotally coupled to the keycap 101 of the key structure 10'. The two hook parts 1042 of each stabilizer bar 104 are penetrated through the corresponding first locking hole 1111 of the first coupling part 111 and the corresponding second locking hole 1121 of the second coupling part 112, respectively.

FIG. 4 schematically illustrates the actions of the stabilizer bar of the keyboard device as shown in FIG. 1. While the keycap 101 of the key structure 10' is moved upwardly or downwardly relative to the base plate 11, the stabilizer bar 104 is moved in the direction D11 or the direction D12 and rotated in the direction D13 or the direction D14. Due to this design, the key structure 10' is kept stable and not inclined while the key structure 10' is moved upwardly or downwardly relative to the base plate 11. Moreover, this design is helpful to increase the strength of the keycap 101.

FIG. 5 is a schematic enlarged view illustrating the connection between a hook part of the stabilizer bar and the corresponding first locking hole of the first coupling part as shown in FIG. 4. Due to the process variation of the first coupling part 111 and the second coupling part 112 of the base plate 11, the conventional keyboard device 1 still has some drawbacks. For example, after the two hook parts 1042 of the stabilizer bar 104 are respectively penetrated through the corresponding first locking hole 1111 of the first coupling part 111 and the corresponding second locking hole 1121 of the second coupling part 112, there is a gap G between the hook part 1042 of each stabilizer bar 104 and the inner wall of the first locking hole 1111 (and the second locking hole 1121). For succinctness, only the hook part 1042 penetrated through the first locking hole 1111 is shown in FIG. 5. Due to the gap G, the stabilizer bar 104 cannot effectively assist in the action of the keycap 101 while the corner of the key structure 10' is pressed down. Under this circumstance, the key structure 10' generates an empty travel distance.

In other words, the conventional keyboard device needs to be further improved.

SUMMARY OF THE INVENTION

An object of the present invention provides a keyboard device. The key structure of the keyboard device is specially designed. Consequently, even if the corner of the keycap is pressed down, the problem of causing the empty travel distance will be overcome.

The other objects and advantages of the present invention will be understood from the disclosed technical features.

In accordance with an aspect of the present invention, a keyboard device is provided. The keyboard device includes a base plate and a key structure. The base plate includes a first coupling part. The first coupling part includes a first locking hole. The key structure includes a keycap, a stabilizer bar and a first connecting element. The keycap is located over the base plate. The stabilizer bar is arranged between the keycap and the base plate. The stabilizer bar includes a transverse bar part and a first hook part. The transverse bar part is pivotally coupled to the keycap. The first hook part is penetrated through the first locking hole of the first coupling part. The first connecting element is arranged between the keycap and the base plate. The keycap is movable upwardly or downwardly relative to the base plate through the first connecting element. The first connecting element includes a first supporting structure. The first supporting structure is arranged between the first hook part of the stabilizer bar and the base plate. The first hook part is supported by the first supporting structure. Consequently, the first hook part is contacted with an inner wall of the first locking hole.

In an embodiment, the key structure further includes a second connecting element. The second connecting element is arranged between the keycap and the base plate and located beside the first connecting element. The keycap is movable upwardly or downwardly relative to the base plate through the first connecting element and the second connecting element. The second connecting element includes a second supporting structure.

In an embodiment, the base plate further includes a second coupling part, and the second coupling part includes a second locking hole. The stabilizer bar further includes a second hook part. The second hook part is penetrated through the second locking hole of the second coupling part. The second supporting structure of the second connecting element is arranged between the second hook part of the stabilizer bar and the base plate. The second hook part is supported by the second supporting structure. Consequently, the second hook part is contacted with an inner wall of the second locking hole.

In an embodiment, the first supporting structure of the first connecting element has a first supporting surface, and the second supporting structure of the second connecting element has a second supporting surface. The first hook part of the stabilizer bar is contacted with the first supporting surface. There is a first included angle between the first hook part of the stabilizer bar and the first supporting surface. The second hook part of the stabilizer bar is contacted with the second supporting surface. There is a second included angle between the second hook part of the stabilizer bar and the second supporting surface.

In an embodiment, while the keycap is moved upwardly or downwardly relative to the base plate through the first connecting element and the second connecting element, the stabilizer bar is correspondingly swung. As the stabilizer bar is swung, the first hook part of the stabilizer bar is slid along the first supporting surface of the first supporting structure and the inner wall of the first locking hole, and the second hook part of the stabilizer bar is slid along the second supporting surface of the second supporting structure and the inner wall of the second locking hole.

In an embodiment, while the keycap is moved downwardly relative to the base plate through the first connecting element and the second connecting element and the keycap is moved to a terminal point of a travel distance, the first supporting surface of the first supporting structure is in parallel with the first hook part of the stabilizer bar, and the second supporting surface of the second supporting structure is in parallel with the second hook part of the stabilizer bar.

In an embodiment, the first connecting element further includes a first outer frame and a first inner frame pivotally coupled to the first outer frame, and the second connecting element further includes a second outer frame and a second inner frame pivotally coupled to the second outer frame. While the keycap is moved downwardly or upwardly relative to the base plate through the first connecting element and the second connecting element, the first outer frame and the first inner frame are correspondingly swung by using a pivotal region between the first outer frame and the first inner frame as a fulcrum, and the second outer frame and the second inner frame are correspondingly swung by using a pivotal region between the second outer frame and the second inner frame as the fulcrum.

In an embodiment, the first outer frame of the first connecting element has a first lateral side and a second lateral side opposed to the first lateral side, and the second outer frame of the second connecting element has a third lateral side and a fourth lateral side opposed to the third lateral side. The second lateral side of the first outer frame and the third lateral side of the second outer frame face each other, the first supporting structure is located at the first lateral side of the first outer frame, and the second supporting structure is located at the fourth lateral side of the second outer frame. The keyboard device further includes a switch circuit board. The switch circuit board is arranged between the key structure and the base plate. When the switch circuit board is triggered by the key structure, the switch circuit board generates a key signal.

In an embodiment, the first connecting element and the second connecting element are scissors-type connecting elements.

From the above descriptions, the present invention provides a keyboard device. In the key structure of the keyboard device, the supporting structure of the connecting element is used to support the stabilizer bar and limit the position of the stabilizer bar. Consequently, after the stabilizer bar is penetrated through the coupling part of the base plate, the stabilizer bar is closely contacted with the inner wall of the coupling part. Due to this structural design, the stabilizer bar can effectively support the keycap. Consequently, even if the corner of the keycap is pressed down, the problem of causing the empty travel distance will be overcome.

The above objects and advantages of the present invention will become more readily apparent to those ordinarily skilled in the art after reviewing the following detailed description and accompanying drawings, in which:

DETAILED DESCRIPTION OF THE PREFERRED EMBODIMENT

Figure 1:
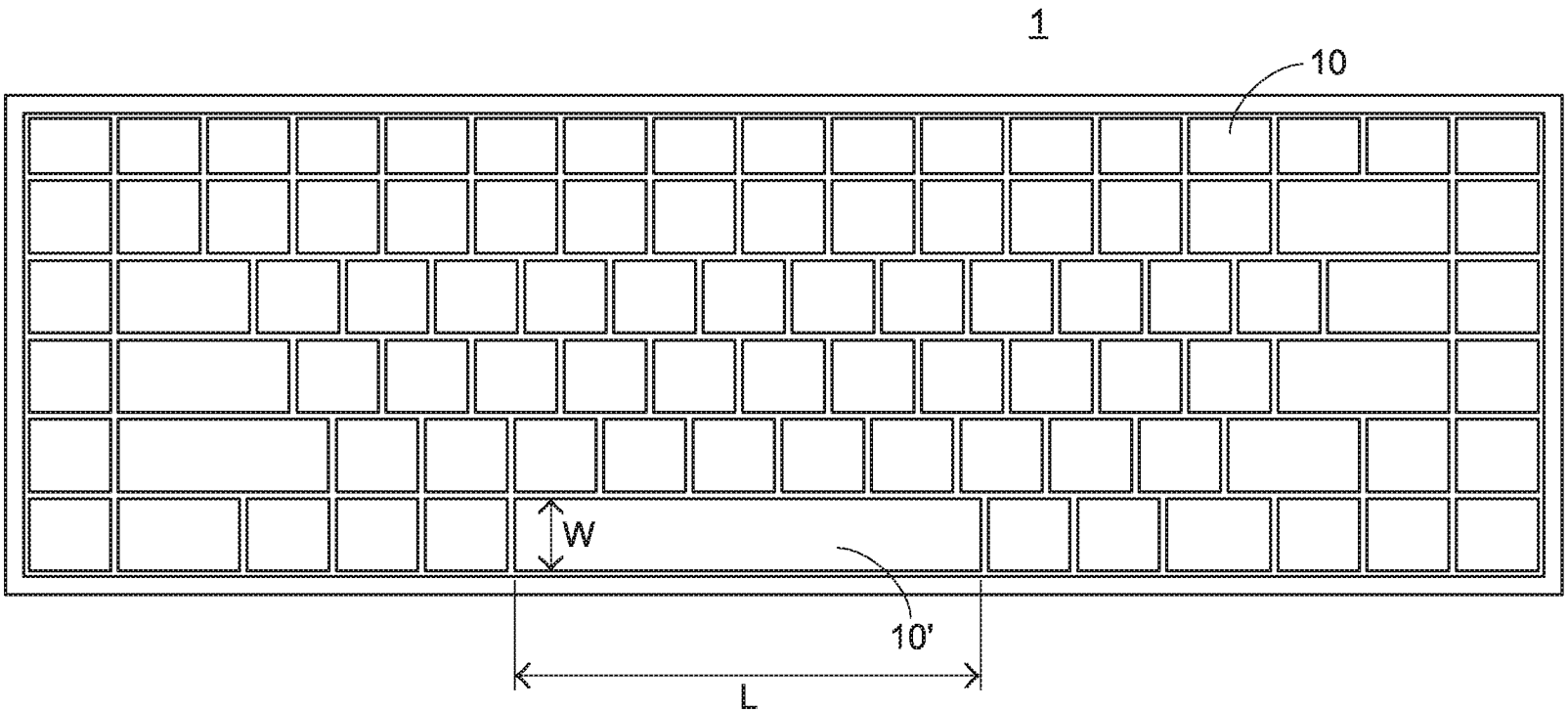
FIG.1 PRIOR ART
FIG. 1 is a schematic top view illustrating the outer appearance of a conventional keyboard device.
Figure 2:
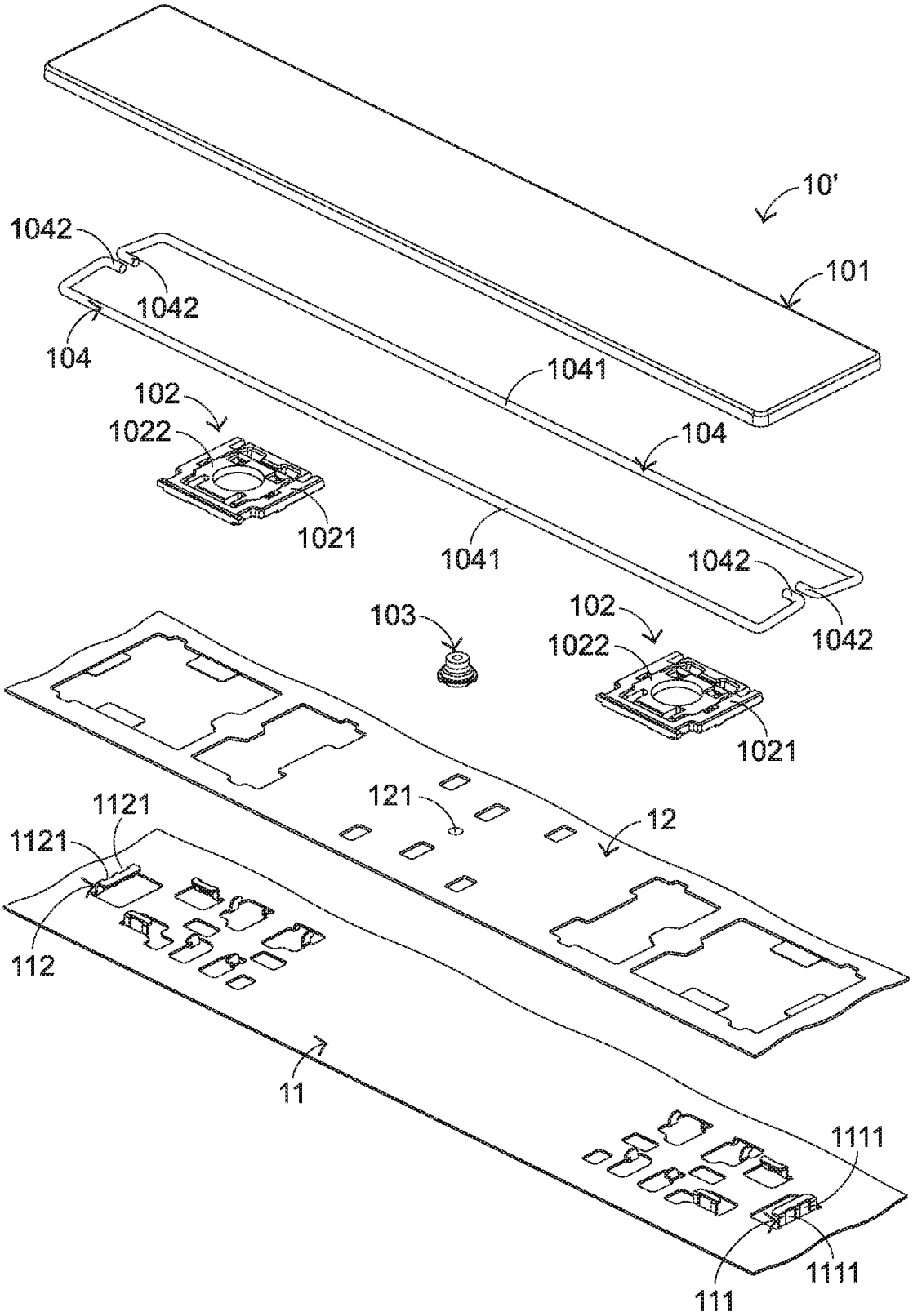
FIG.2 PRIOR ART
FIG. 2 is a schematic exploded view illustrating a portion of the keyboard device of FIG. 1 and taken along a viewpoint.
Figure 3:
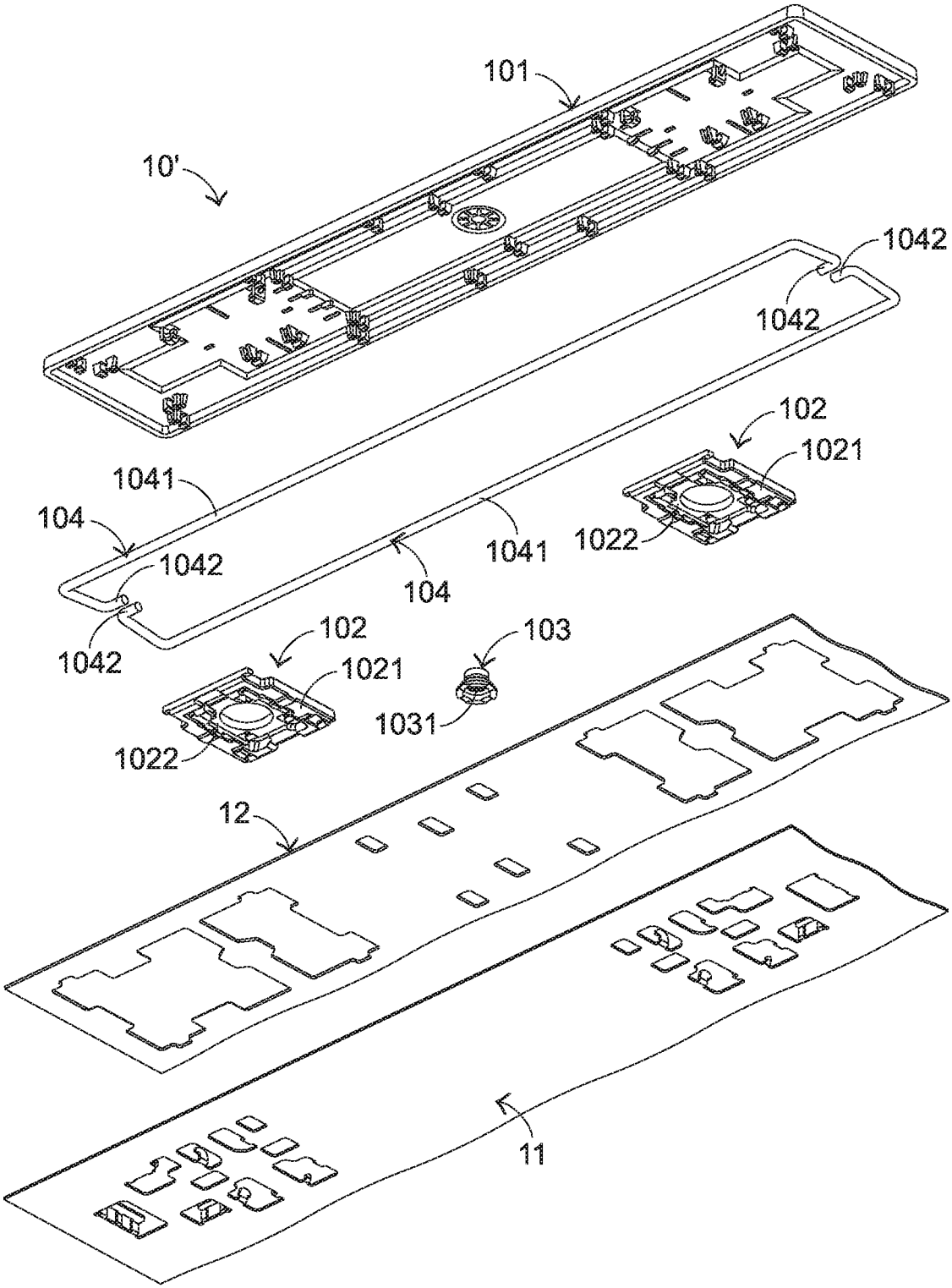
FIG.3 PRIOR ART
FIG. 3 is a schematic exploded view illustrating a portion of the keyboard device of FIG. 1 and taken along another viewpoint.
Figure 4:
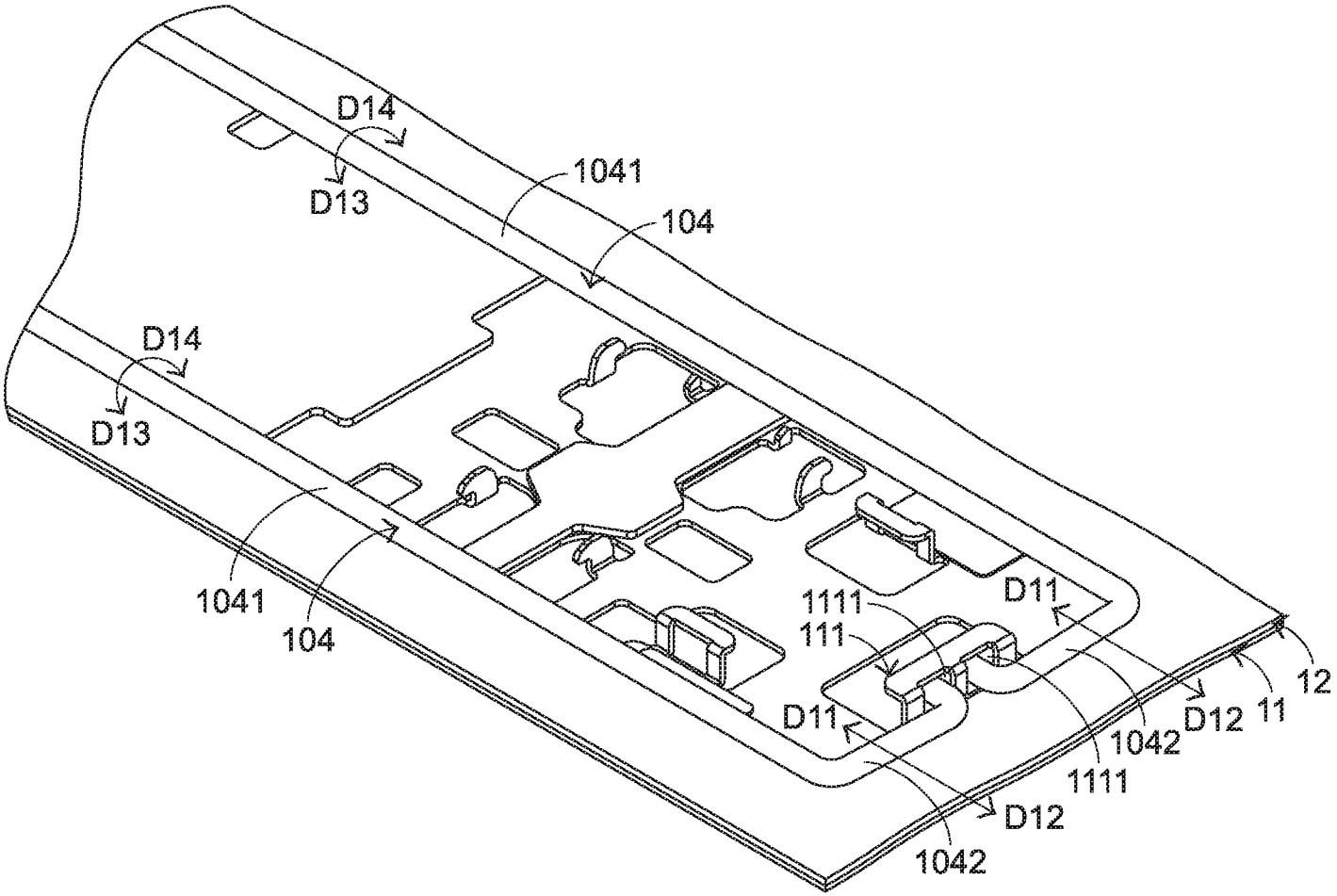
FIG.4 PRIOR ART
FIG. 4 schematically illustrates the actions of the stabilizer bar of the keyboard device as shown in FIG. 1.
Figure 5:
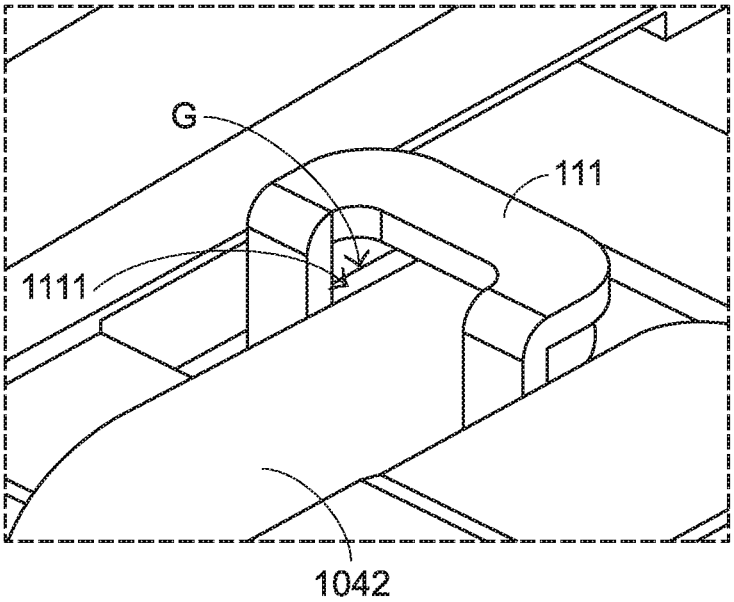
FIG.5 PRIOR ART
FIG. 5 is a schematic enlarged view illustrating the connection between a hook part of the stabilizer bar and the corresponding first locking hole of the first coupling part as shown in FIG. 4.
Figure 6:
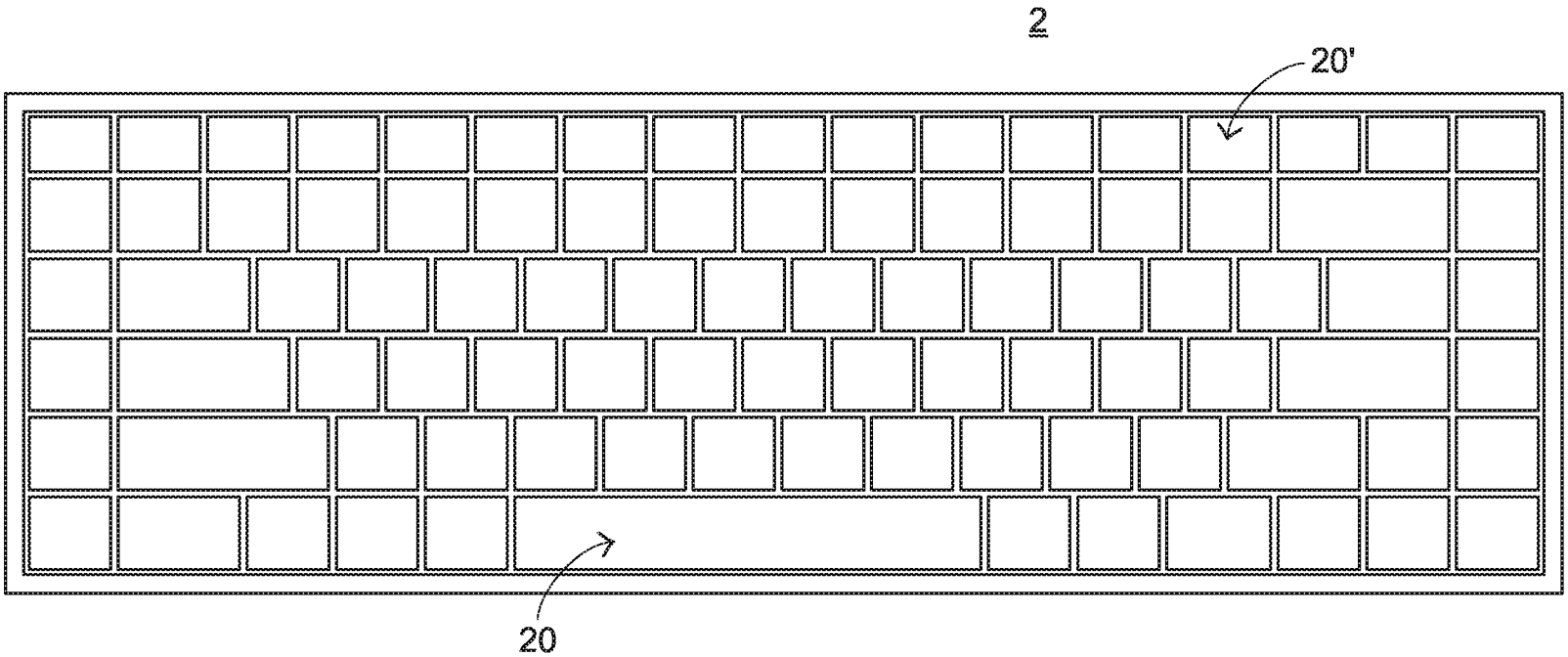
FIG. 6 is a schematic top view illustrating the outer appearance of a keyboard device according to an embodiment of the present invention.
Figure 7:
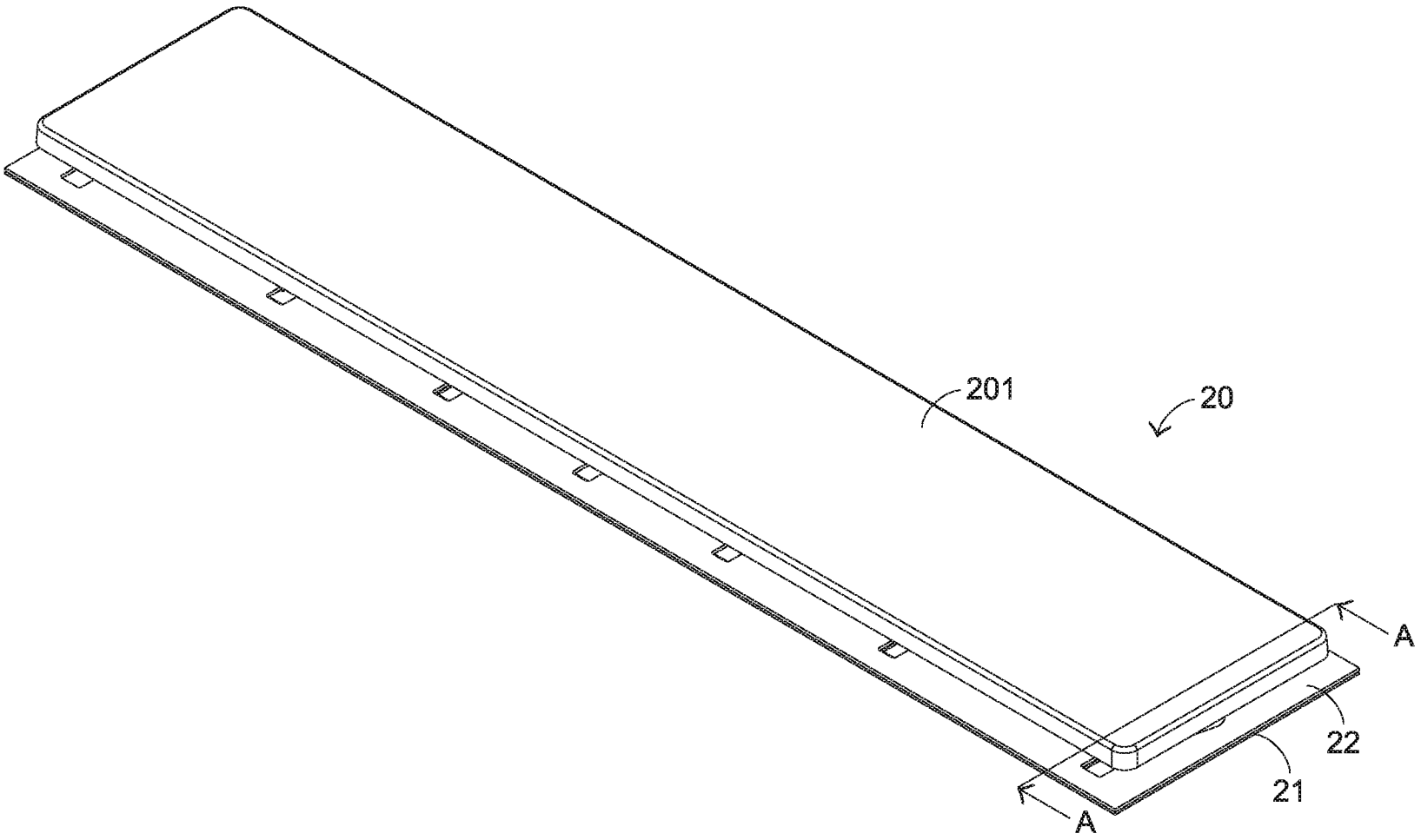
FIG. 7 is a schematic perspective view illustrating a key structure of the keyboard device as shown in FIG. 6.
Figure 8:
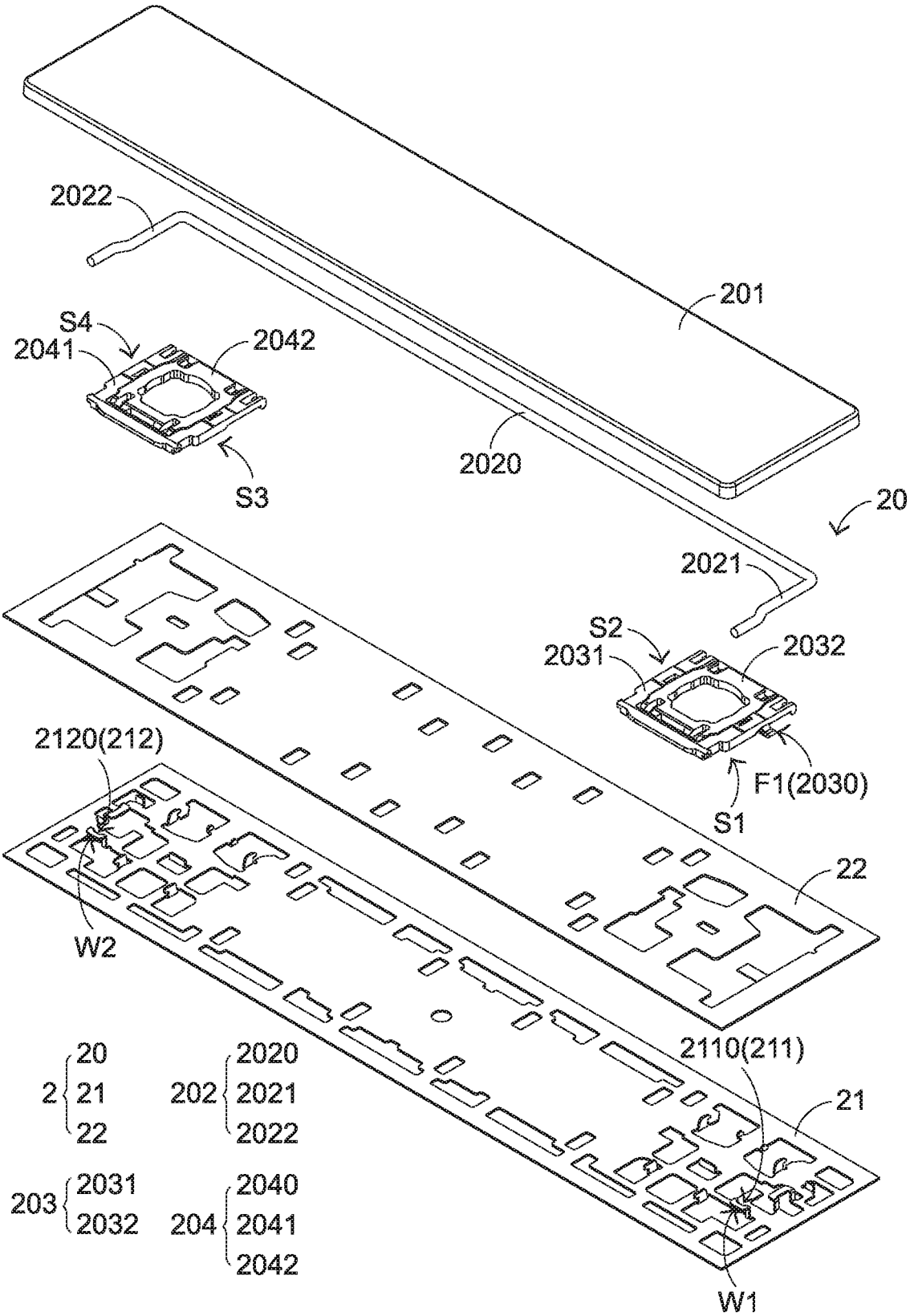
FIG. 8 is a schematic exploded view illustrating the key structure of the keyboard device as shown in FIG. 7 and taken along a viewpoint.
Figure 9:
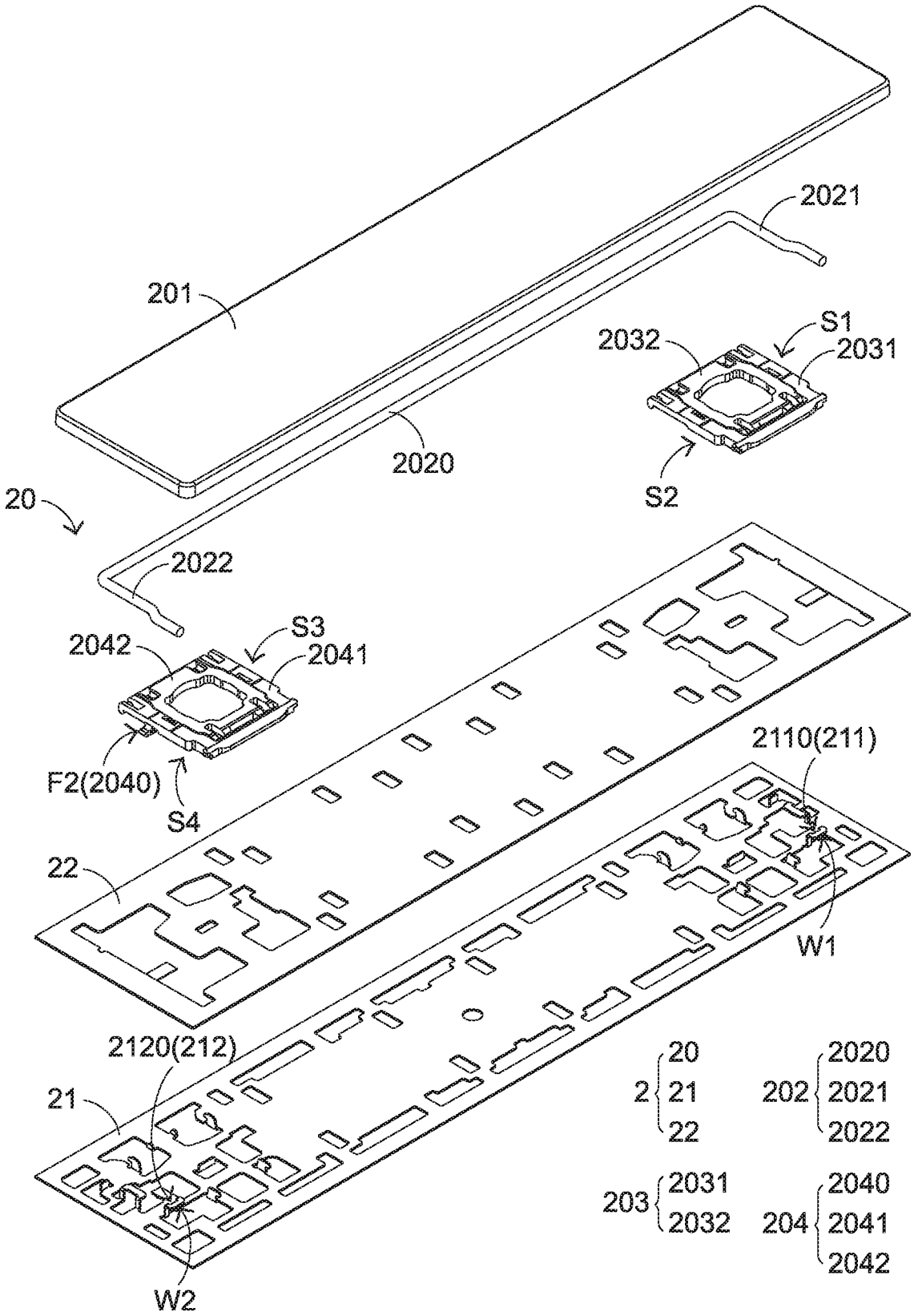
FIG. 9 is a schematic exploded view illustrating the key structure of the keyboard device as shown in FIG. 7 and taken along another viewpoint.
Figure 10:
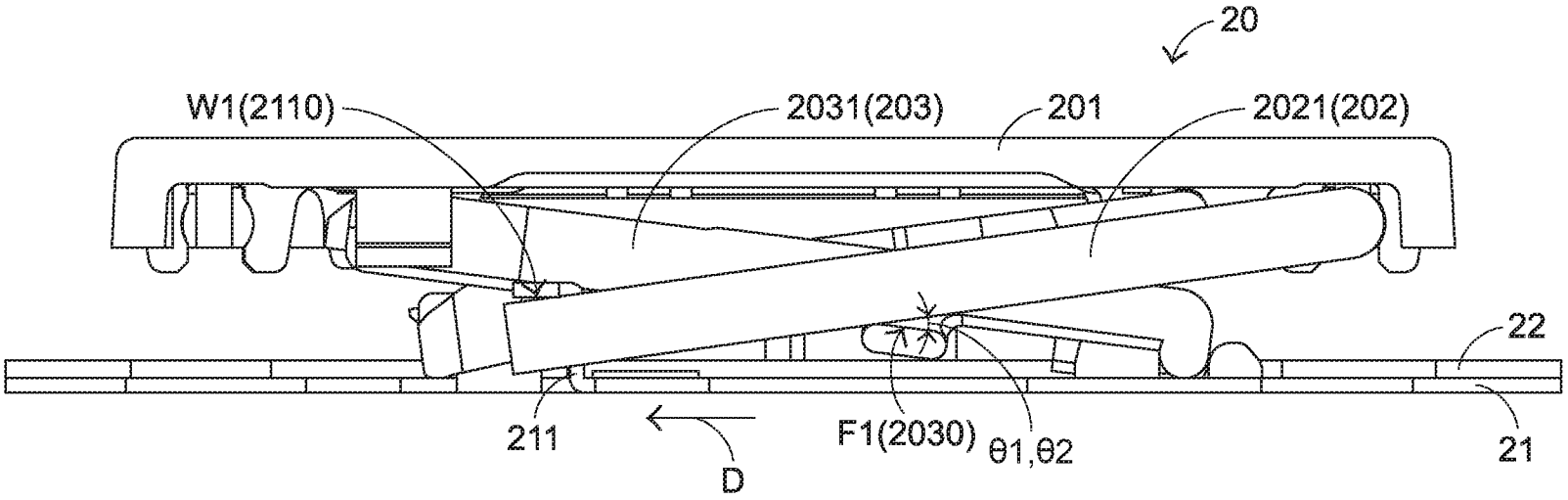
FIG. 10 is a schematic cross-sectional view illustrating the key structure as shown in FIG. 7 and taken along the line AA.
Figure 11:
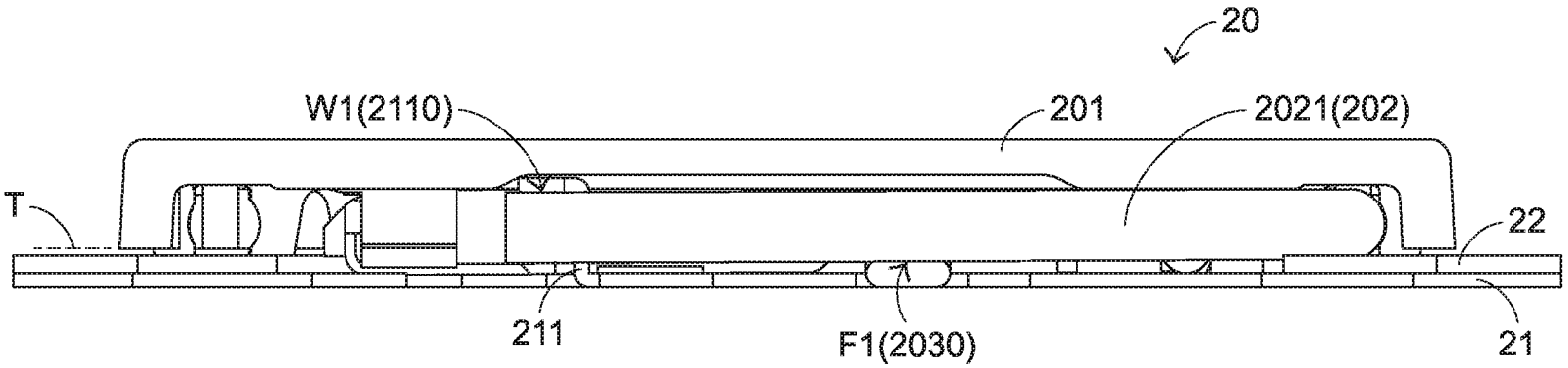
FIG. 11 is a schematic cross-sectional view illustrating the key structure as shown in FIG. 10 and in a depressed state.

Please refer to FIGS. 6, 7, 8, 9, 10 and 11. FIG. 6 is a schematic top view illustrating the outer appearance of a keyboard device according to an embodiment of the present invention. FIG. 7 is a schematic perspective view illustrating a key structure of the keyboard device as shown in FIG. 6. FIG. 8 is a schematic exploded view illustrating the key structure of the keyboard device as shown in FIG. 7 and taken along a viewpoint. FIG. 9 is a schematic exploded view illustrating the key structure of the keyboard device as shown in FIG. 7 and taken along another viewpoint. FIG. 10 is a schematic cross-sectional view illustrating the key structure as shown in FIG. 7 and taken along the line AA. FIG. 11 is a schematic cross-sectional view illustrating the key structure as shown in FIG. 10 and in a depressed state.

As shown in FIG. 6, the keyboard device 2 comprises plural key structures 20 and 20'. The key structures 20' are classified into some types, e.g., ordinary keys, numeric keys and function keys. When one of the key structures 20' is depressed by the user's finger, the keyboard device 2 generates a corresponding key signal to a computer (not show), and thus the computer executes a function corresponding to the depressed key structure. For example, when an ordinary key is depressed, a corresponding English letter or symbol is inputted into the computer. When a numeric key is depressed, a corresponding number is inputted into the computer. In addition, the function keys (F1~F12) can be programmed to provide various quick access functions. The key structure 20 is a Space key, a Shift key or any other similar multiple key with the larger area and length.

In the following embodiment, a portion of the keyboard device 2 will be described. Particularly, the key structure 20 of the keyboard device 2 as shown in FIG. 6 will be described as follows. For succinctness, only one key structure 20 and related components are shown in the drawings.

Please refer to FIGS. 7, 8 and 9. In addition to the key structure 20, the keyboard device 2 further comprises a base plate 21 and a switch circuit board 22. The base plate 21 is located under the key structure 20. The switch circuit board 22 is arranged between the key structure 20 and the base plate 21. The base plate 21 comprises a first coupling part 211 and a second coupling part 212. The first coupling part 211 and the second coupling part 212 are protruded upwardly from the base plate 21. The first coupling part 211 comprises a first locking hole 2110. The second coupling part 212 comprises a second locking hole 2120. When the switch circuit board 22 is triggered by the key structure 20, the switch circuit board 22 generates a key signal. Preferably but not exclusively, the base plate 21 is made of metallic material, and the switch circuit board 22 is a combination of a membrane circuit board and a membrane switch.

Please refer to FIGS. 7, 8, 9, 10 and 11. In this embodiment, the key structure 20 comprises a keycap 201, a stabilizer bar 202, a first connecting element 203 and a second connecting element 204.

The keycap 201 is located over the base plate 21. The stabilizer bar 202 is arranged between the keycap 201 and the base plate 21. The stabilizer bar 202 comprises a transverse bar part 2020, a first hook part 2021 and a second hook part 2022. The transverse bar part 2020 of the stabilizer bar 202 is pivotally coupled to the keycap 201. The first hook part 2021 is connected with the first coupling part 211 of the base plate 21. That is, the first hook part 2021 is penetrated through the first locking hole 2110 of the first coupling part 211. The second hook part 2022 is connected with the second coupling part 212 of the base plate 21. That is, the second hook part 2022 is penetrated through the second locking hole 2120 of the second coupling part 212. Preferably but not exclusively, the transverse bar part 2020, the first hook part 2021 and the second hook part 2022 are integrally formed as a one-piece structure, and these components are made of metallic material.

The first connecting element 203 and the second connecting element 204 are arranged between the keycap 201 and the base plate 21. Particularly, a portion of the first connecting element 203 and a portion of the second connecting element 204 are penetrated through corresponding hollow portions of the switch circuit board 22 and connected with the base plate 21. Moreover, the first connecting element 203 and the second connecting element 204 are arranged beside two opposite sides of the base plate 21, respectively. The keycap 201 is movable upwardly or downwardly relative to be base plate 21 through the first connecting element 203 and the second connecting element 204.

The first connecting element 203 comprises a first supporting structure 2030. The second connecting element 204 comprises a second supporting structure 2040. The first supporting structure 2030 is arranged between the first hook part 2021 of the stabilizer bar 202 and the base plate 21. The first hook part 2021 is supported by the first supporting structure 2030. Consequently, the first hook part 2021 is contacted with an inner wall W1 of the first locking hole 2110. That is, since the position of the first hook part 2021 is limited by the first supporting structure 2030, the first hook part 2021 is continuously contacted with the inner wall W1 of the first locking hole 2110. The second supporting structure 2040 is arranged between the second hook part 2022 of the stabilizer bar 202 and the base plate 21. The second hook part 2022 is supported by the second supporting structure 2040. Consequently, the second hook part 2022 is contacted with an inner wall W2 of the second locking hole 2120. That is, since the position of the second hook part 2022 is limited by the second supporting structure 2040, the second hook part 2022 is continuously contacted with the inner wall W2 of the second locking hole 2120.

Please refer to FIGS. 7, 8, 9, 10 and 11 again. The first connecting element 203 further comprises a first outer frame 2031 and a first inner frame 2032, which are pivotally coupled to each other. The second connecting element 204 further comprises a second outer frame 2041 and a second inner frame 2042, which are pivotally coupled to each other. While the keycap 201 is moved downwardly or upwardly relative to the base plate 21, the first outer frame 2031 and the first inner frame 2032 are correspondingly swung relative to the pivotal region (i.e., a fulcrum) between the first outer frame 2031 and the first inner frame 2032, and the second outer frame 2041 and the second inner frame 2042 are correspondingly swung relative to the pivotal region (i.e., a fulcrum) between the second outer frame 2041 and the second inner frame 2042.

The first outer frame 2031 of the first connecting element 203 has a first lateral side S1 and a second lateral side S2, which are opposed to each other. The second outer frame 2041 of the second connecting element 204 has a third lateral side S3 and a fourth lateral side S4, which are opposed to each other. The second lateral side S2 of the first outer frame 2031 and the third lateral side S3 of the second outer frame 2041 face each other. The first supporting structure 2030 of the first connecting element 203 is located at the first lateral side S1 of the first outer frame 2031 (i.e., the external side of the first outer frame 2031). The second supporting structure 2040 of the second connecting element 204 is located at the fourth lateral side S4 of the second outer frame 2041. Preferably but not exclusively, the first connecting element 203 and the second connecting element 204 are scissors-type connecting elements.

Please refer to FIGS. 7, 8, 9, 10 and 11 again. The first supporting structure 2030 of the first connecting element 203 has a first supporting surface F1. The second supporting structure 2040 of the second connecting element 204 has a second supporting surface F2. The first hook part 2021 of the stabilizer bar 202 is supported on and contacted with the first supporting surface F1 of the first supporting structure 2030. The second hook part 2022 of the stabilizer bar 202 is supported on and contacted with the second supporting surface F2 of the second supporting structure 2040.

In the above embodiment, the key structure 20 comprises a single stabilizer bar 202. It is noted that the number of the stabilizer bar is int restricted. For example, in another embodiment, the key structure comprises two or more stabilizer bars. For example, an additional stabilizer bar is located at a position opposite to the stabilizer bar 202, or at least one additional stabilizer bar is arranged between the first connecting element 203 and the second connecting element 204.

The operations of the key structure 20 will be described in more details as follows.

Please refer to FIG. 10. Before the keycap 201 of the key structure 20 is pressed down, the first hook part 2021 of the stabilizer bar 202 is supported on and contacted with the first supporting surface F1 of the first supporting structure 2030. Under this circumstance, there is a first included angle θ1 between the first hook part 2021 of the stabilizer bar 202 and the first supporting surface F1 of the first supporting structure 2030. While the keycap 201 of the key structure 20 is pressed down and the keycap 201 is moved downwardly relative to the base plate 21 through the first connecting element 203 and the second connecting element 204, the transverse bar part 2020 of the stabilizer bar 202 is moved downwardly with the keycap 201. As the transverse bar part 2020 of the stabilizer bar 202 is moved downwardly, the first hook part 2021 of the stabilizer bar 202 is swung downwardly and slid along the first supporting surface F1 of the first supporting structure 2030 and the inner wall W1 of the first locking hole 2110 in a direction D. In other words, the first included angle θ1 between the first hook part 2021 of the stabilizer bar 202 and the first supporting surface F1 of the first supporting structure 2030 is gradually decreased.

Please refer to FIG. 11. As the keycap 201 of the key structure 20 is moved downwardly relative to the base plate 21 through the first connecting element 203 and the second connecting element 204 and moved to the terminal point T of the travel distance, the first supporting surface F1 of the first supporting structure 2030 is in parallel with the first hook part 2021 of the stabilizer bar 202. Under this circumstance, the first included angle θ1 between the first hook part 2021 of the stabilizer bar 202 and the first supporting surface F1 of the first supporting structure 2030 is 0 degree.

Moreover, the actions of the second connecting element 204 cooperating with the second hook part 2022 are similar to the actions of the first connecting element 203 cooperating with the first hook part 2021 of the stabilizer bar 202. In most situations, the actions of the first connecting element 203 and the second connecting element 204 are synchronous. For succinctness, only the actions of the first connecting element 203 cooperating with the first hook part 2021 of the stabilizer bar 202 are shown and described in FIGS. 10 and 11. Similarly, before the keycap 201 of the key structure 20 is pressed down, the second hook part 2022 of the stabilizer bar 202 is supported on and contacted with the second supporting surface F2 of the second supporting structure 2040. Under this circumstance, there is a second included angle θ2 between the second hook part 2022 of the stabilizer bar 202 and the second supporting surface F2 of the second supporting structure 2040. The second included angle θ2 is equal to the first included angle θ1. While the keycap 201 of the key structure 20 is pressed down and the keycap 201 is moved downwardly relative to the base plate 21 through the first connecting element 203 and the second connecting element 204, the transverse bar part 2020 of the stabilizer bar 202 is moved downwardly with the keycap 201. As the transverse bar part 2020 of the stabilizer bar 202 is moved downwardly, the second hook part 2022 of the stabilizer bar 202 is swung downwardly and slid along the second supporting surface F2 of the second supporting structure 2040 and the inner wall W2 of the second locking hole 2120 in the direction D.

As mentioned above, the first hook part 2021 and the second hook part 2022 of the stabilizer bar 202 are supported on and contacted with the first supporting structure 2030 of the first connecting element 203 and the second supporting structure 2040 of second connecting element 204, respectively. Consequently, while the first hook part 2021 and the second hook part 2022 are swung downwardly and slid in the direction D, the first supporting structure 2030 and the second supporting structure 2040 are pressed by the first hook part 2021 and the second hook part 2022, respectively. In this way, the first hook part 2021 and the second hook part 2022 provide downward pressing forces to the first connecting element 203 and the second connecting element 204 through the first supporting structure 2030 and the second supporting structure 2040. That is, while the keycap 201 of the key structure 20 is moved downwardly relative to the base plate 21 through the first connecting element 203 and the second connecting element 204, the first connecting element 203 and the second connecting element 204 are swung downwardly with the movement of the keycap 201, and the first connecting element 203 and the second connecting element 204 are swung downwardly with the assistance of the downward pressing forces of the first hook part 2021 and the second hook part 2022 of the stabilizer bar 202. Due to this structural design, the key structure 20 can provide good tactile feel.

As mentioned above, while the first hook part 2021 and the second hook part 2022 are slid, the first supporting surface F1 of the first supporting structure 2030 and the second supporting surface F2 of the second supporting structure 2040 continuously provide proper supporting forces to the first hook part 2021 and the second hook part 2022, respectively. Since the first hook part 2021 and the second hook part 2022 are continuously contacted with the inner wall W1 of the first locking hole 2110 and the inner wall W2 of the second locking hole 2120 during the sliding process, no gaps are generated. In other words, the stabilizer bar 202 can effectively support the keycap 201. Consequently, even if the corner of the keycap 201 is pressed down, the problem of causing the empty travel distance will be overcome.

In the above embodiment as shown in FIGS. 6 to 11, the key structure 20 is a Space key, a Shift key or any other similar multiple key with the larger area and length. Alternatively, the key structure 20 of the present invention may be applied to an ordinary key of imputing an English letter or a symbol, a numeric key for inputting a number or a function key for providing a quick access function. That is, the applications of the key structure of the present invention are not restricted. In the above embodiment, the key structure 20 comprises the first connecting element 203 and the second connecting element 204. In some embodiments, the above concepts can be applied to the key structure 20' as shown in FIG. 6. Since the area and length of the key structure 20' are smaller than the area and length of the key structure 20, the key structure 20' with a single connecting element is feasible.

From the above descriptions, the present invention provides a keyboard device. In the key structure of the keyboard device, the supporting structure of the connecting element is used to support the stabilizer bar and limit the position of the stabilizer bar. Consequently, after the stabilizer bar is penetrated through the coupling part of the base plate, the stabilizer bar is closely contacted with the inner wall of the coupling part. Due to this structural design, the stabilizer bar can effectively support the keycap. Consequently, even if the corner of the keycap is pressed down, the problem of causing the empty travel distance will be overcome.

While the invention has been described in terms of what is presently considered to be the most practical and preferred embodiments, it is to be understood that the invention needs not be limited to the disclosed embodiments. On the contrary, it is intended to cover various modifications and similar arrangements included within the spirit and scope of the appended claims which are to be accorded with the broadest interpretation so as to encompass all modifications and similar structures.

What is claimed is:

1. A keyboard device, comprising:

a base plate comprising a first coupling part, wherein the first coupling part comprises a first locking hole; and a key structure comprising:

a keycap located over the base plate;

a stabilizer bar arranged between the keycap and the base plate, wherein the stabilizer bar comprises a transverse bar part and a first hook part, wherein the transverse bar part is pivotally coupled to the keycap, and the first hook part is penetrated through the first locking hole of the first coupling part; and a first connecting element and a second connecting element arranged between the keycap and the base plate, wherein the keycap is movable upwardly or downwardly relative to the base plate through the first connecting element, and the first connecting element comprises a first supporting structure, wherein the first supporting structure is arranged between the first hook part of the stabilizer bar and the base plate, and the first hook part is supported by the first supporting structure, so that the first hook part is contacted with an inner wall of the first locking hole, wherein the first connecting element and the second connecting element are scissors-type connecting elements.

2. The keyboard device according to claim 1, wherein the second connecting element is located beside the first connecting element, wherein the keycap is movable upwardly or downwardly relative to the base plate through the first connecting element and the second connecting element, and the second connecting element comprises a second supporting structure.

3. The keyboard device according to claim 2, wherein the base plate further comprises a second coupling part, and the second coupling part comprises a second locking hole, wherein the stabilizer bar further comprises a second hook part, and the second hook part is penetrated through the second locking hole of the second coupling part, wherein the second supporting structure of the second connecting element is arranged between the second hook part of the stabilizer bar and the base plate, and the second hook part is supported by the second supporting structure, so that the second hook part is contacted with an inner wall of the second locking hole.

4. The keyboard device according to claim 3, wherein the first supporting structure of the first connecting element has a first supporting surface, and the second supporting structure of the second connecting element has a second supporting surface, wherein the first hook part of the stabilizer bar is contacted with the first supporting surface, and there is a first included angle between the first hook part of the stabilizer bar and the first supporting surface, wherein the second hook part of the stabilizer bar is contacted with the second supporting surface, and there is a second included angle between the second hook part of the stabilizer bar and the second supporting surface.

5. The keyboard device according to claim 4, wherein while the keycap is moved upwardly or downwardly relative to the base plate through the first connecting element and the second connecting element, the stabilizer bar is correspondingly swung, wherein as the stabilizer bar is swung, the first hook part of the stabilizer bar is slid along the first supporting surface of the first supporting structure and the inner wall of the first locking hole, and the second hook part of the stabilizer bar is slid along the second supporting surface of the second supporting structure and the inner wall of the second locking hole.

6. The keyboard device according to claim 4, wherein while the keycap is moved downwardly relative to the base plate through the first connecting element and the second connecting element and the keycap is moved to a terminal point of a travel distance, the first supporting surface of the first supporting structure is in parallel with the first hook part of the stabilizer bar, and the second supporting surface of the second supporting structure is in parallel with the second hook part of the stabilizer bar.

7. The keyboard device according to claim 2, wherein the first connecting element further comprises a first outer frame and a first inner frame pivotally coupled to the first outer frame, and the second connecting element further comprises a second outer frame and a second inner frame pivotally coupled to the second outer frame, wherein while the keycap is moved downwardly or upwardly relative to the base plate through the first connecting element and the second connecting element, the first outer frame and the first inner frame are correspondingly swung by using a pivotal region between the first outer frame and the first inner frame as a fulcrum, and the second outer frame and the second inner frame are correspondingly swung by using a pivotal region between the second outer frame and the second inner frame as the fulcrum.

8. The keyboard device according to claim 7, wherein the first outer frame of the first connecting element has a first lateral side and a second lateral side opposed to the first lateral side, and the second outer frame of the second connecting element has a third lateral side and a fourth lateral side opposed to the third lateral side, wherein the second lateral side of the first outer frame and the third lateral side of the second outer frame face each other, the first supporting structure is located at the first lateral side of the first outer frame, and the second supporting structure is located at the fourth lateral side of the second outer frame.

9. The keyboard device according to claim 1, wherein the keyboard device further comprises a switch circuit board, and the switch circuit board is arranged between the key structure and the base plate, wherein when the switch circuit board is triggered by the key structure, the switch circuit board generates a key signal.

* * * * *